US006199306B1

(12) United States Patent
Kauppila et al.

(10) Patent No.: US 6,199,306 B1
(45) Date of Patent: Mar. 13, 2001

(54) HIGH EFFICIENCY SNOW THROWER

(75) Inventors: Richard W. Kauppila, 158 S. Basin Dr., Negaunee, MI (US); Raymond W. Kauppila, Marquette, MI (US)

(73) Assignee: Richard W. Kauppila, Negaunee, MI (US)

( * ) Notice: Subject to any disclaimer, the term of this patent is extended or adjusted under 35 U.S.C. 154(b) by 0 days.

(21) Appl. No.: 09/307,682

(22) Filed: May 10, 1999

(51) Int. Cl.[7] ..... E01H 5/09
(52) U.S. Cl. ..... 37/249
(58) Field of Search ..... 37/219, 221, 223, 37/241, 242, 244, 248, 249, 250, 251

(56) References Cited

U.S. PATENT DOCUMENTS

| | | | | |
|---|---|---|---|---|
| 301,506 | | 7/1884 | Massey . | |
| 2,166,667 | * | 7/1939 | Watkins | 37/249 |
| 2,337,108 | * | 12/1943 | Jensen | 37/250 |
| 2,482,213 | * | 9/1949 | Ritchie | 37/250 |
| 2,736,111 | | 2/1956 | Moen | 37/43 |
| 2,777,217 | * | 1/1957 | Klauer | 37/250 |
| 3,276,571 | | 10/1966 | Vohl | 198/217 |
| 3,340,626 | * | 9/1967 | Konucik | 37/249 |
| 3,999,316 | * | 12/1976 | Palmer | 37/249 |
| 5,398,432 | * | 3/1995 | Vohl | 37/250 |

* cited by examiner

*Primary Examiner*—Robert E. Pezzuto
(74) *Attorney, Agent, or Firm*—John R. Benefiel

(57) ABSTRACT

A high efficiency snow thrower relying on a cutting action to create snow chunks which are conveyed and discharged, using one or more cutter bar arrays arranged in the front opening of a housing and an auger member which also has a cutting edge on helically wound strips splitting the packed snow and conveying chunks of the same while importing significant velocity to an impeller pocket at the center of the helical strip, which discharges snow chunks out through a discharge chute.

11 Claims, 5 Drawing Sheets

HIGH EFFICIENCY SNOW THROWER

BACKGROUND OF THE INVENTION

This invention concerns machines which remove deep snow from roadways, driveways, etc. by conveying the snow to an impeller which throws the snow some distance from the machine, either to be collected for transport or into a pile some distance from the roadway.

A common arrangement is the combination of a rotating auger-screw conveyor the front of the machine which feeds snow into a separate central impeller.

This arrangement consumes considerable power since it pulverizes the snow, grinding it into a powder. The auger is also used to break up packed snow, which it does but quite-inefficiently as it utilizes a scraping action to accomplish this.

The impeller also consumes considerable power in throwing the snow in the finely powered condition in which it is received by the impeller from the auger.

These inefficiencies require high horsepower engines, which result in heavy and costly machines.

It is the object of the present invention to provide a combination of elements which efficiently breaks up the snow and propels the same away in such a manner that only a considerably reduced horsepower is required for a given application.

SUMMARY OF THE INVENTION

The above recited object and others which will become apparent upon a reading of the following specification and claims are achieved by providing an arrangement of elements which act primarily to cut up by splitting the compacted snow or other material rather than to break up the snow by the grinding and scraping action heretofore relied on.

Specifically, one or more arrays of rotating cutter assemblies (bars are shown in this example) are located just forward of a rotating auger-cutter member. The cutters comprise a series of bars each having a blade end extending generally axially but angled slightly to create a slicing and pulling action when driven by the rotation of a mounting shaft.

The auger-cutter member includes a rotating cylindrical shaft or tubular mounting extending on an axis that will contribute to the desired action and to the rear of the cutter bar shaft, a pair of opposite helically wound conveying strip segments projecting from the surface of the auger. An axially extending cutter edge is formed along each radial strip, angled slightly to create a slicing, gathering action and confining the cut material to effectively impart kinetic energy to the conveyed chunks of material to assist in the throwing action.

The oppositely helically wound strip segments meet at the auger center where an impeller pocket is formed by the joined strip ends.

A wedge shaped shield deflector is disposed forward of the center where the impeller pocket is located to move the material to the sides and into the adjacent cutter bars and auger cutter strips for cutting and conveyance to the impeller pocket.

The packed material is efficiently cut into chunks rather than being pulverized by the cutter arms and auger edge. The cut up material is conveyed into the impeller pocket at sufficient velocity as to contribute to the throwing action imparted by the impeller itself.

DESCRIPTION OF THE DRAWING FIGURES

DETAILED DESCRIPTION

Figure 1:
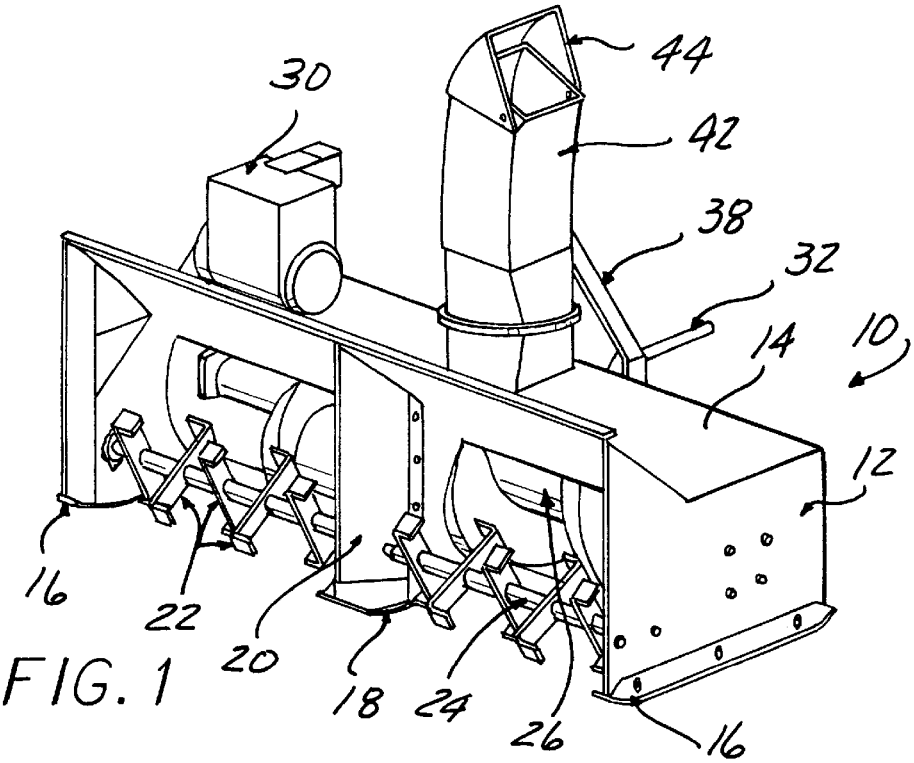
FIG. 1 is a front perspective view of a high efficiency snow thrower according to the present invention.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings and particularly FIGS. 1–7, a snow thrower 10 according to the present invention is shown which includes an outer sheet metal housing 12, open at the front with an upwardly angled top 14 defining input advanced against the piled snow.

The housing 12 is supported with an adjustable height skid plate 16 at each end and a center skid plate 18 attached to a centrally locator deflector piece 20 mounted to extend across the opening at the front of the housing.

An array of cutter bars 22 radially extend generally outwardly from a shaft 24 rotatably mounted extending horizontally across the lower region of the front opening of the housing 12.

An auger member 26 is mounted recessed within the housing 12 to be rotatable about an axis parallel to the cutter bar shaft 24. Other orientations of the auger member 26 are possible as long as the cutting conveying action is achieved.

The cutter bar shaft 24 and auger member 26 are both rotated by a drive unit 28 (FIG. 3) powered either by an engine 30 mounted on the housing top 14 or a power take off shaft 32, right angle drive 34 and cross shaft 36. Other suitable means for powering these components may be used.

The snow thrower 10 shown is suitable for a tractor mount using bracket 38, and a suitable connection to the PTO (not shown) is made to shaft 32. An auger tube 40 open at the front partially encloses the auger member 26.

The improved snow thrower efficiency is achieved by the unique configuration and action of the auger member 26, and also by that of the cutter bar array for heavier capacity snow throwers.

Specifically, the auger member 26 has features which cut the snow into chunks, and convey the same axially in such a way as to impart substantial kinetic energy to the cut chunks, significantly contributing to an impelling action produced by a pocket formed at the center of the auger member 28, forcefully directing the conveyed chunks through an outlet chute 42 mounted over the center of the housing top 14. The chute 42 is rotatable with a swingable baffle 44 allowing control over the direction of the stream of snow exiting the chute 42.

The auger member 26 in this example includes a cylindrical mounting comprised of a hollow tube 46 rotatable on the bearings 48 supported on the respective housing sidewalls 50. A conveying strip 52 projects from the tube 46 and has opposite segments wound helically in from each end in an opposite handedness to convey snow towards the center. The conveyance in this unit is toward the center, but other arrangements can be utilized.

A cutter-confinement edge 54 is formed along the length the strip 52, extending axially towards the center.

Figure 5:
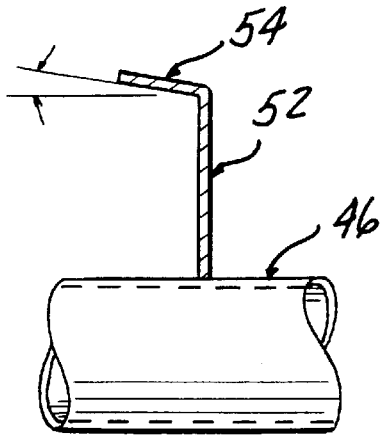
FIG. 5 is a fragmentary front view of a portion of the auger shown in FIG. 4 with the conveying strip and cutter edge.
Figure 1B:
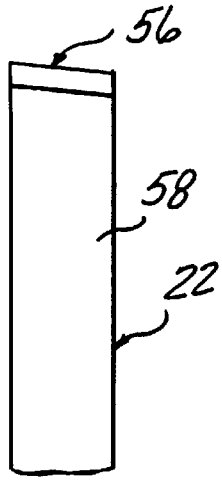
FIG. 1B is an end view of the cutting bar end view shown in FIG. 1A.

The cutter edge 54 is angled outwardly slightly as shown in FIG. 5 to create a slicing, gathering action in splitting packed snow and to create a slinging action when conveying the snow.

It is important that the edge 54 rotates in close proximity to the auger tube 40 (FIG. 7) without creating any wedging action tending to jam the snow, to minimize grinding of the snow.

A wear plate 56 is welded to the bottom of the auger tube 40.

The oppositely wound segments of the auger strip 52 meet at the center of the machine where they form an impeller pocket 60 (FIG. 4) which extends out to impart a throwing action, directing the cut up snow into the chute 42 located directly over the impeller pocket 60.

Figure 1A:
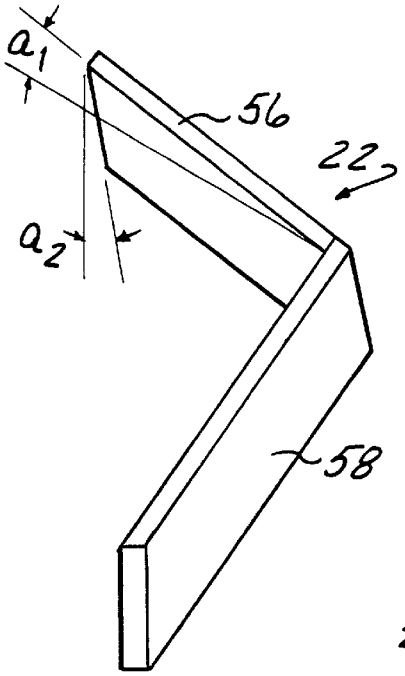
FIG. 1A is an enlarged perspective view of an end portion of a cutting bar incorporated in the snow thrower shown in FIG. 1.
Figure 2:
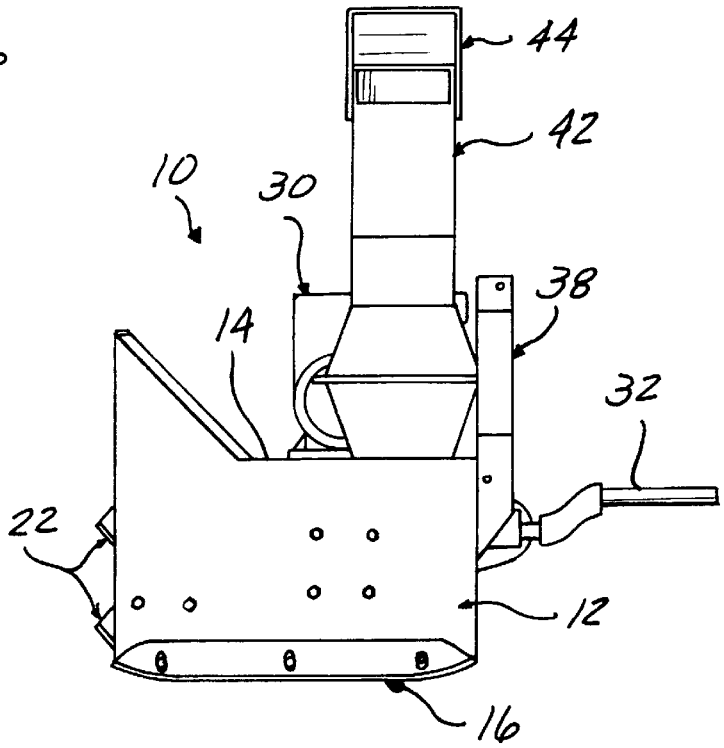
FIG. 2 is an end view of the snow thrower shown in FIG. 1.

The cutter bars 22 also each have an angled end 56, inclined at an angle $a_1$ from the axial direction and tilted radially out at an angle $a_2$ (FIG. 1A) from the circumferential direction. This geometry creates a splitting, wedging, and gathering action as the edges of the ends 56 penetrate the packed snow, cutting the snow into chunks with a minimal energy expenditure.

The cut up snow chunks are passed into the auger member 26, where further cutting occurs as described above, and the chunks are conveyed to the impeller pocket. The auger member 26 is rotated at relatively high speed, i.e., on the order of 200 rpm in order to function as an impeller conveyor.

Figure 6:
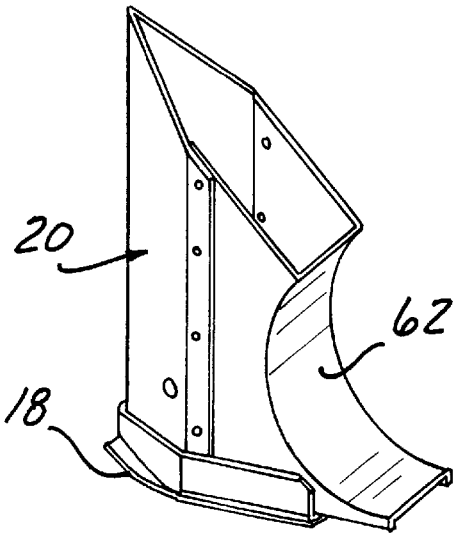
FIG. 6 is an enlarged perspective view of a deflector shield structure included in the snow thrower of FIGS. 1–3.
Figure 7:
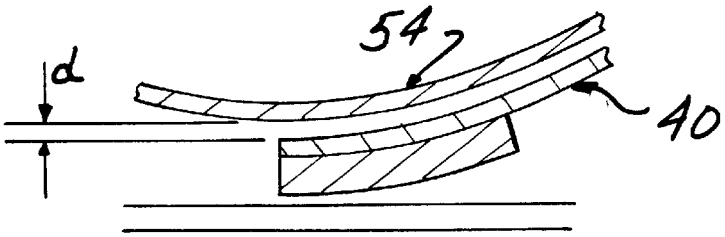
FIG. 7 is an enlarged sectional view taken through the bottom of the auger-cutter and a fragmentary portion of the auger housing.
Figure 3:
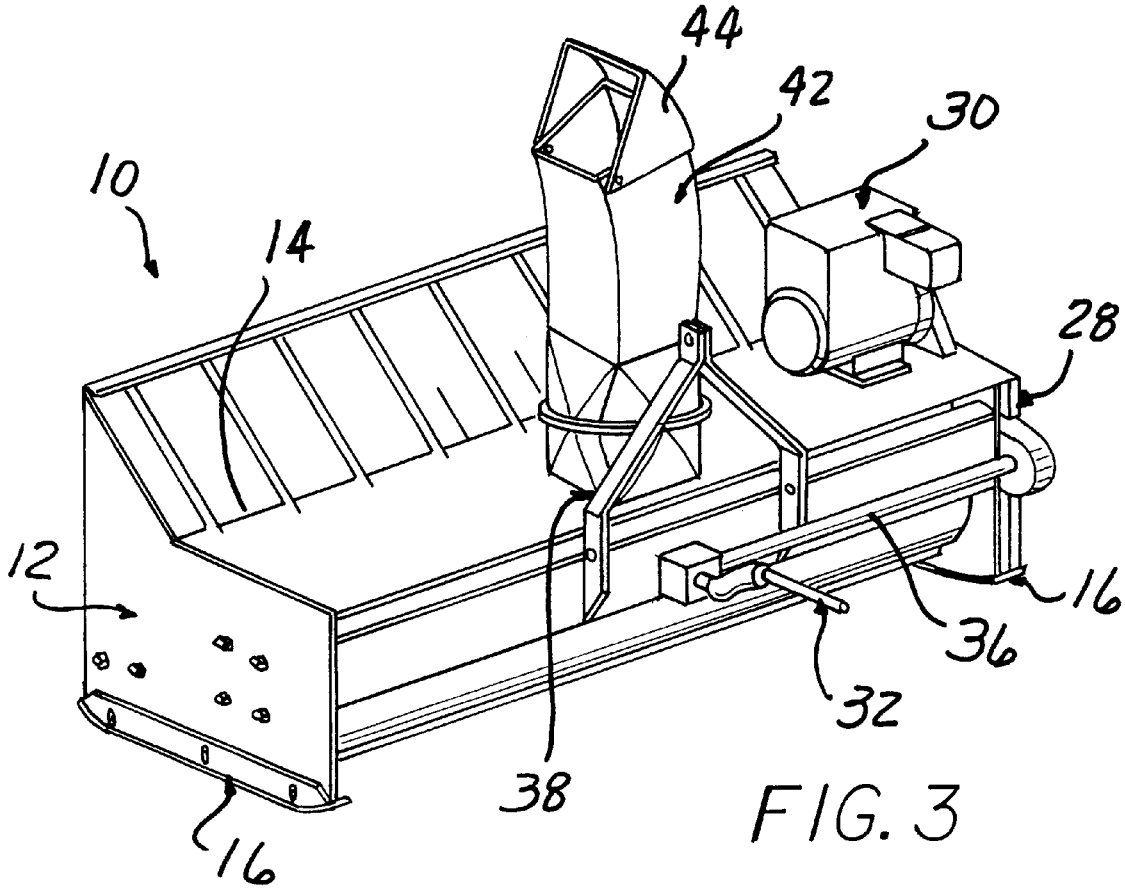
FIG. 3 is a rear perspective view of the snow thrower shown in FIGS. 1 and 2.
Figure 4:
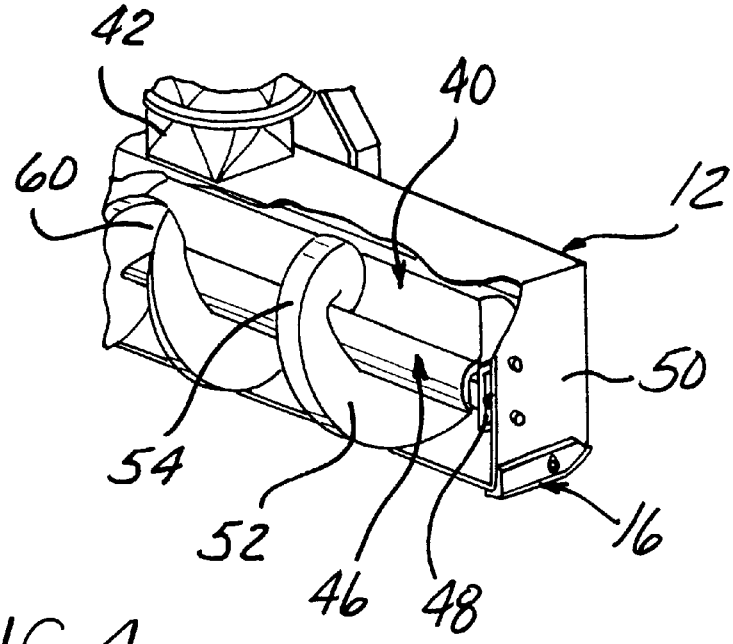
FIG. 4 is a fragmentary perspective view of one end of the auger member and adjacent housing portions included in the snow thrower shown in FIGS. 1–3.

The deflector shield 20 is located forwardly of the impeller pocket 60 to divert the snow to the adjacent portions of the conveyor strip 52 to prevent the impeller pocket 60 from expending energy simply slapping at the snow (FIG. 6).

The deflector shield 20 is formed of sheet metal, with a wedge shaped front piece attached to a rear section formed with a radiused face 62 receiving the auger member 26 and impeller pocket 60.

Figure 8:
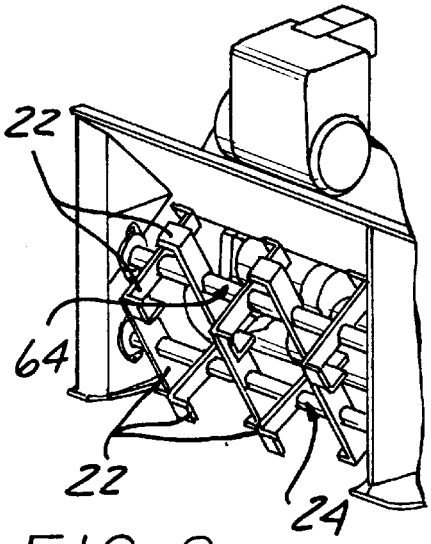
FIG. 8 is a fragmentary view of a snow thrower having two cutter bar arrays.

A second array of cutter bars 22 may be provided on a second shaft 64 extending parallel and above the first bar 24 to improve performance in deeper snow packs, as shown in FIG. 8.

Figure 9:
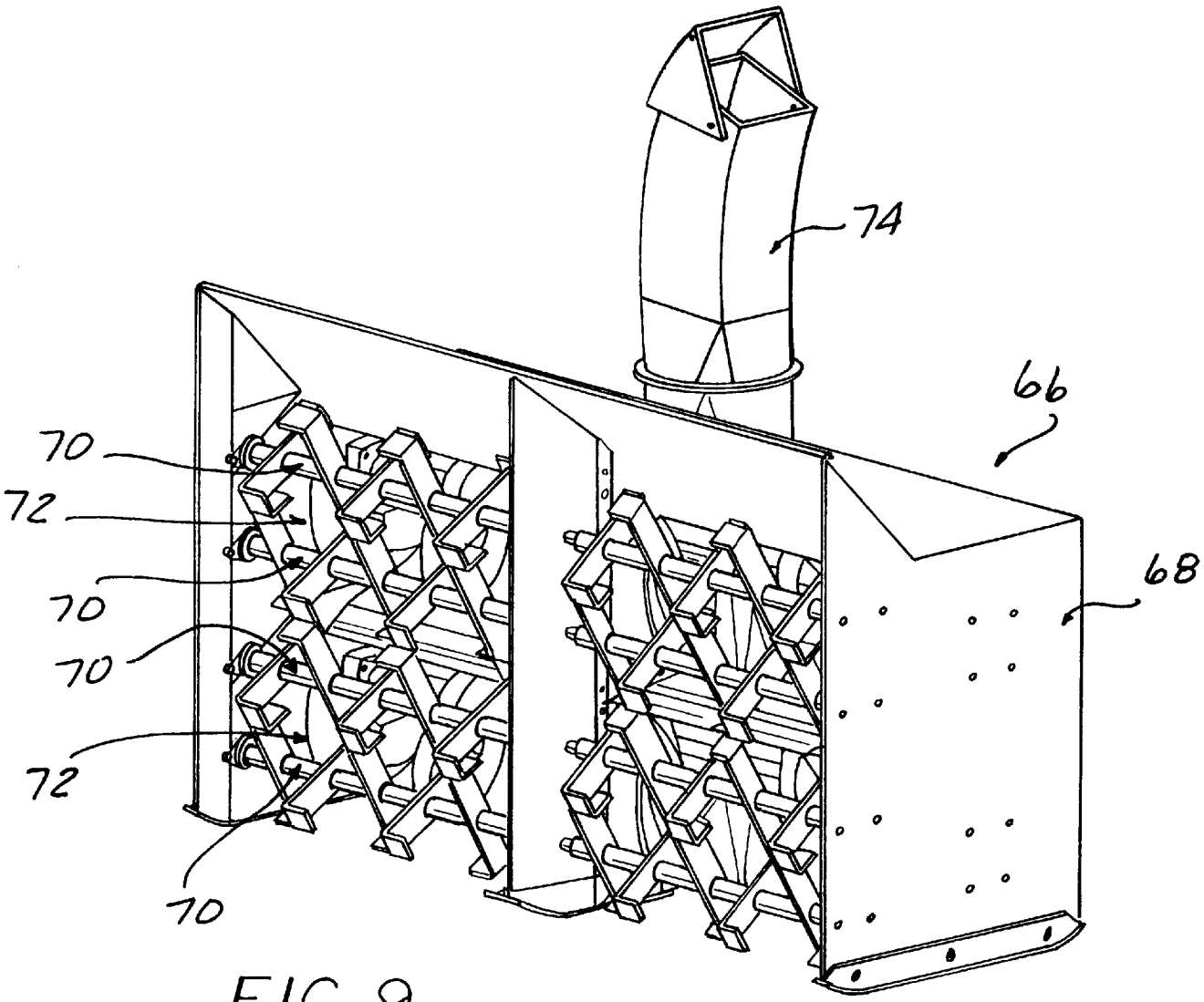
FIG. 9 is a front perspective view of another embodiment of the snow thrower having four stacked cutter bar arrays and two stacked auger conveyor cutter members.

FIG. 9 shows a heavy duty version 66 suitable for mounting to road clearing trucks, in which a much larger housing 68 mounts four stacked cutter bar shafts 70 arranged within the open front of the housing 68.

Two stacked auger members 72 are rotatably mounted in the housing 68, located behind multiple cutter bar arrays.

A larger chute 74 receives the larger volume of snow chunks.

Figure 10:
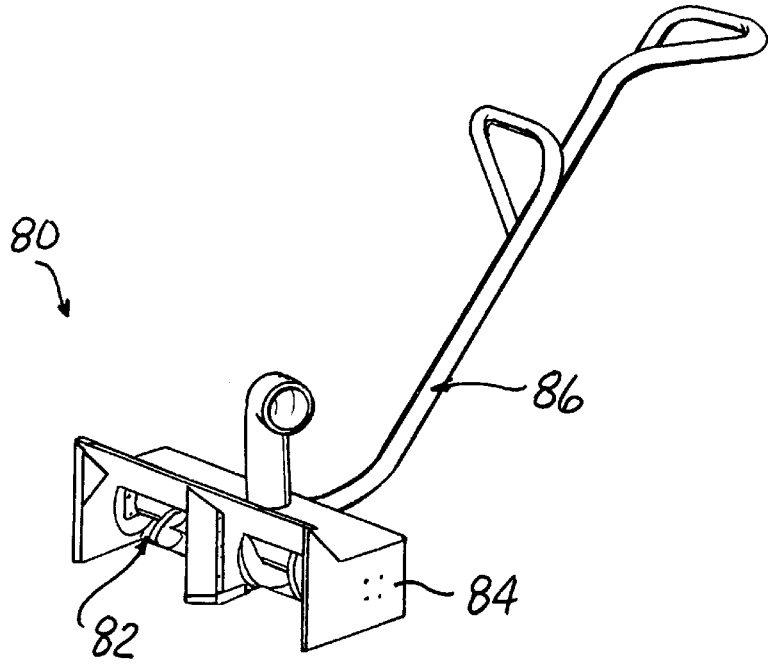
FIG. 10 is a perspective view of a simplified snow thrower according to the present invention showing a snow shovel application.

FIG. 10 shows a much smaller shovel version of the snow thrower 80, which consists of a single smaller auger member 82 in a smaller housing 84 attached to a long handle 86. The cutter bar array is not included. The auger member 82 may be directly powered with an electric motor and extension cord (not shown).

Figure 11:
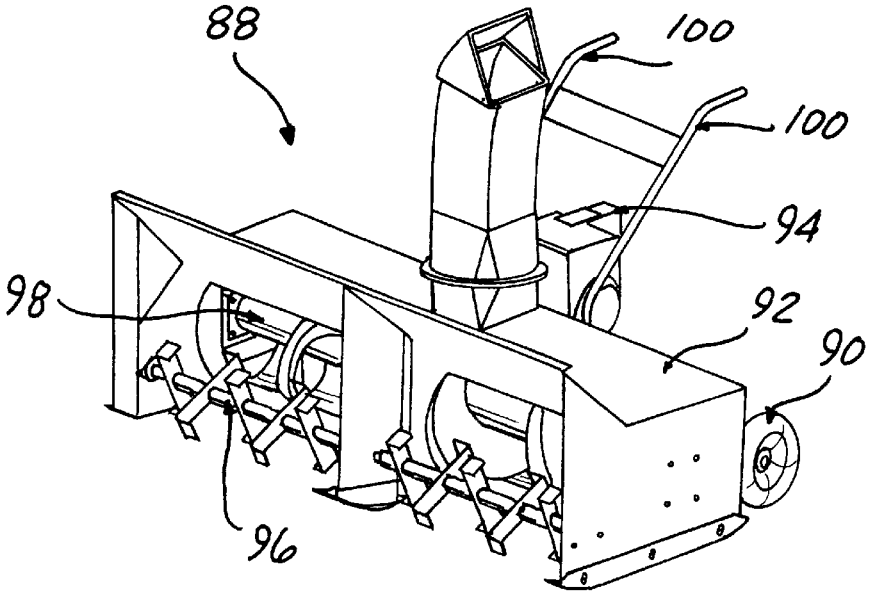
FIG. 11 is a perspective view of a self propelled walk behind application of the snow thrower according to the present invention.

Finally, FIG. 11 shows a self propelled walk behind version 88, in which wheels 90 support the housing 92, an engine 94 powering the wheels 90 as well as a cutter bar shaft 96 and auger member 98 rotatable in the housing 92 as in the above described embodiments.

A pair of outwardly angled handles 100 allow steering control in a well known fashion.

It will be appreciated that a high efficiency is achieved by minimizing the energy expended in comminuting the snow, instead cutting the snow into small enough chunks to create a flowable mass, and devoting most of the energy expended on imparting kinetic energy to this mass. The larger particle sizes are able to be thrown more effectively than a fine powder of snow.

It should be understood that the efficiency of operation allows the use of the machines on materials other than snow, i.e., soil, sand, etc.

What is claimed is:

1. A material throwing machine, comprising:

a housing having a partially cylindrical rear surface and an open front;

an auger member comprising a cylindrical member rotatably mounted within said housing extending across said open front of said housing and a strip affixed to said cylindrical member to project radially from an outer surface of said cylindrical member and having opposite segments extending in from each of opposite ends of said cylindrical member in opposite handed helical windings about said cylindrical member, said strip segments rotating in close proximity to said cylindrical rear surface of said housing, an impeller pocket joined to said strip segments intermediate the ends of said cylindrical member whereat said opposite handed helical in segments meet, said impeller pocket configured to receive material advanced along said cylindrical member inwardly to said impeller pocket, and slinging material radially outwardly by rotation of said impeller pocket by rotation of said cylindrical member;

a deflector shield mounted to said housing at the center thereof shielding said impeller pocket and having a radius inside face within which said impeller pocket rotates which is also confined by said cylindrical rear surface of said housing;

a discharge chute located directly above said impeller pocket to receive snow;

a rotary drive rotating said cylindrical member at a sufficiently high rate to cause material fed into said impeller pocket to be discharged from said machine by being slung from said impeller pocket directed upwardly therefrom.

2. The machine according to claim 1 wherein said strip further has a cutter edge portion extending at an angle to said strip to project axially from a radially outermost portion thereof, said edge portion rotated in close proximity to said housing rear surface with no wedging action.

3. The machine according to claim 2 wherein said cutter edge is angled slightly in a radial outward direction.

4. The machine according to claim 1 further including at least one array of cutter bars extending radially from a cutter drive shaft rotatably parallel and mounted forward of said auger member, said cutter drive shaft driven by said rotary drive.

5. The machine according to claim 4 wherein said cutter bars include a main portion extending outwardly from said cutter drive shaft and a tip portion angled outwardly from said main portion.

6. The machine according to claim 5 wherein said tip portion is also angled away from the direction of rotation thereof.

7. The machine according to claim 1 further including an elongated handle attached to said housing to enable use of said machine as a shovel, said machine being sufficiently compact and lightweight to allow lifting thereof by a person using said handle.

8. The machine according to claim 1 wherein said deflector shield fixed to said housing has a wedge shaped front diverting material to the side thereof to adjacent portions of said auger member.

9. The machine according to claim 4 further including another cutter bar array and cutter bar shaft mounted in said housing opening and located above said one another cutter bar array and cutter bar shaft.

10. The machine according to claim 9 further including additional cutter bar arrays and cutter bar shafts mounted in said housing stacked above said one and another cutter bar array and shafts.

11. The machine according to claim 10 further including another auger member stacked above said at least one auger member and rotatable in said housing.

* * * * *